US005980214A

United States Patent [19]

Djordjevic

[11] Patent Number: 5,980,214

[45] Date of Patent: Nov. 9, 1999

[54] FLUID PUMP WITH SPLIT PLUNGERS

[75] Inventor: Ilija Djordjevic, East Granby, Conn.

[73] Assignee: Stanadyne Automotive Corp., Windsor, Conn.

[21] Appl. No.: 08/928,312

[22] Filed: Sep. 12, 1997

[51] Int. Cl.[6] ..... F04B 23/08

[52] U.S. Cl. ..... 417/205; 417/273; 92/255; 92/72

[58] Field of Search ..... 92/72, 255, 129; 417/205, 273

[56] References Cited

U.S. PATENT DOCUMENTS

| | | | |
|---|---|---|---|
| 3,067,728 | 12/1962 | Bordini | 92/72 |
| 4,662,825 | 5/1987 | Djordjevic | 417/273 |
| 5,228,844 | 7/1993 | Klopfer et al. | 417/440 |

*Primary Examiner*—Timothy S. Thorpe
*Assistant Examiner*—Cheryl J. Tyler
*Attorney, Agent, or Firm*—Alix, Yale & Ristas, LLP

[57] ABSTRACT

A fuel pump (10) for supplying fuel to an internal combustion engine employs at least one composite pumping plunger (43) disposed within a plunger bore (46) for reciprocation therein. Each composite plunger comprises at least a high-pressure plunger element (48), which is in contact with a high-pressure fuel charge to be delivered by the pump, and an abutting leak-off plunger element (47) disposed between the high-pressure element and a plunger actuating member (50, 52). The plunger elements of each composite plunger are stacked in the direction of reciprocation such that the abutting plunger elements form confronting end faces. The confronting end face of at least one of the elements in each composite plunger is contoured and the confronting end face of the abutting element is non-complementary in shape. This arrangement of confronting faces of abutting plunger elements causes the composite plungers to freely reciprocate within the plunger bores in self-centering fashion and provides a tighter seal at the interfaces of the composite plungers and the plunger bores.

17 Claims, 5 Drawing Sheets

FLUID PUMP WITH SPLIT PLUNGERS

BACKGROUND OF THE INVENTION

1. Field of the Invention

The present invention generally relates to pumps for delivering pulses of high pressure fluid. More particularly, the invention relates to an improved pump for supplying high-pressure diesel fuel for injection into an internal combustion engine. Accordingly, the general objects of the present invention are to provide novel and improved methods and apparatus of such character.

2. Description of the Related Art

Fuel pumps for supplying fuel to internal combustion engines are well known in the art. Conventional fuel pumps of this type are, for example, employed by diesel engines. Such diesel pumps are typically rotary pumps which have solid, cylindrical plungers radially reciprocating in corresponding pumping plunger bores. Fuel at inlet pressures is supplied through inlet passages to the plunger bores, and fuel at outlet pressures is discharged through discharge passages from the plunger bores as a result of actuation of the plungers. In the case of a pump which has such radially pressurizing plungers, one or more cam rings provide camming surfaces for actuating the plungers via a plurality of intermediate members. Each intermediate member is typically comprised of a roller which is guided along one or more camming surfaces of one of the cam rings and an adjacent shoe which contacts one of the plungers. Thus, the camming surface of the cam ring slides against the rollers to periodically impart motion to the intermediate members, which motion causes corresponding movement of the plungers within the plunger bores. Although generally effective, pumps of this type suffer from the deficiency that high torque loads and high frictional forces are generated during the sliding of the one-piece plungers within the plunger bores.

Undesirable torque loads (or side-loading) and frictional forces present in conventional pumping plungers during operation thereof arise, in part, from the use of the rotating cam rings to impart radially reciprocal movement of the pumping plungers. In particular, difficulty arises because the cam surface of the rotating cam ring necessarily imparts both radial and tangential force components to the pumping plunger via the intermediate member. While the radial force component produces the desired radial reciprocal movement of the plunger, the tangential force component inherently causes the plungers to cant off-center during motion of the plunger within the bore. This plunger-canting causes the opposite sides of each plunger to bear against the plunger bore during movement of the plunger.

An additional factor which can result in undesirable friction forces being created is plunger deformation during pump operation. As the plungers of conventional pumps experience reciprocal movement, they are subjected to forces on opposite ends thereof. In particular, while one end of the plunger is subjected to the force created by the back-pressure of the fuel to be pumped, the opposite end of the plunger is subjected to the force imparted by the cam ring and intermediate member. In a high pressure fuel pump for a diesel engine, the pressure acting on the plunger can easily be on the order of 20,000 psi (1380 Bar) during normal operation. Accordingly, such plungers typically experience heavy loading which has a tendency to temporarily shorten the length of a plunger and temporarily increase the thickness of the plunger in a direction transverse to the plunger axis. This is especially true in the low pressure section where the plunger is allowed to expand freely. In the high pressure section, the diametral expansion is reduced because of the radial forces generated by the high pressure. This temporary plunger deformation, in turn, exacerbates the frictional loading occurring during plunger movement because a deformed plunger can seize against the wall of a plunger bore.

A final and competing consideration affecting the movement of pumping plungers within the pumping bores is that of fuel leakage through the component interfaces of the pump, e.g., at the interface of the pumping plungers and walls defining the plunger bores. This consideration is important because the seal at the interface of the plungers and the bores must be maintained as tight as possible to maximize pumping pressure and minimize fuel leak-off during operation of the pump. However, component tolerances must still remain loose enough to accommodate the pumping plunger deformation which occurs during operation of the pump. This consideration places a limit on the obtainable quality of the seal between the various components. Thus, while fuel leak-off is desirably minimized, it must be tolerated.

Together, the above-described factors result in high-pressure fuel pumps which experience unusually large fuel leak-off during operation and/or plungers which do not freely travel within the plunger bores during reciprocation thereof.

Accordingly, there remains a need for an improved fuel pump which overcomes the aforementioned deficiencies, by providing an arrangement of pumping plungers which more closely approximate ideal operation during usage.

Further, there remains a need in the art for an improved fuel pump which overcomes the aforementioned deficiencies by reducing fuel leak-off created during operation of the fuel pump.

There also remains a need in the art for an improved fuel pump which overcomes the aforementioned deficiencies by providing an arrangement of pumping plungers which will not seize against the walls of the plunger bores during reciprocation.

SUMMARY OF THE INVENTION

It is, accordingly, a primary object of the present invention to provide new and improved pumps for supplying fuel to internal combustion engines which do not have associated with them the aforementioned deficiencies and shortcomings of known pumps.

Another and more specific object of the present invention aims at providing new and improved fuel pumps which experience lower leak-off fuel rates during operation.

Still another object of the present invention aims at providing new and improved fuel pumps having reciprocating plungers which are subjected to lower torsional loads and frictional forces during operation.

Yet another significant object of the present invention aims at providing new and improved fuel pumps of the character described above which are relatively simple in construction and design, economical to manufacture, highly reliable in operation, and require a minimum of maintenance and servicing.

These and further objects and advantages of the present invention are achieved in one embodiment by providing a pump for supplying fuel to an internal combustion engine, which employs a composite, or split, pumping plunger within each pumping plunger bore for reciprocation therein.

Each split plunger comprises at least a high-pressure plunger element, which is in contact with the high-pressure fuel charge to be delivered by the pump, and a leak-off plunger element disposed between the high-pressure element and a plunger actuating member. The plunger elements of each composite plunger are stacked in the direction of reciprocation such that the abutting plunger elements form confronting end faces. The confronting end face of at least one of the leak-off or the high-pressure elements is contoured and the confronting end face of the abutting element is non-complementary in shape. This arrangement of confronting faces of abutting plunger elements causes the composite plungers to freely reciprocate within the plunger bores in self-centering fashion and provides a tighter seal at the interfaces of the composite plungers and the plunger bores.

In practice, the composite plungers of this invention reduce high-pressure fuel leak-off within the inventive pump. This fuel leak-off reduction is achieved by insulating the off-center movement of the high-pressure plunger element from the movement of the plunger actuating member, by the presence of a separate leak-off plunger element. Thus, while side loading force components are transferred by the plunger actuating member to the leak-off plunger element, these force components are not transferred from the leak-off plunger element to the high-pressure plunger element. The high-pressure plunger element, therefore, experiences self-centering reciprocal movement within the plunger bore, i.e., plunger element canting is greatly reduced if not eliminated during reciprocation of the high-pressure plunger element.

Moreover, plunger deformation in the composite plungers of the instant invention is limited. This leads to a concomitant reduction or elimination of plunger seizure in the inventive pump. In particular, plunger deformation is largely limited to the leak-off plunger and, hence, far less deformation occurs in the high-pressure plunger element. Therefore, the high-pressure plunger element can be enlarged to fit the complementary plunger bore much more closely without inhibiting free movement -of the plunger. The resulting tighter seal between the plunger bore and the high-pressure plunger element significantly reduces fuel leak-off at the interface of the composite plunger and the plunger bore.

A further advantage to the composite plungers of the present invention is that the confronting end faces of the high-pressure plunger and the leak-off plunger inherently produce a leak-off fuel gallery which facilitates the removal of any fuel which does happen to leak past the high-pressure plunger element. Thus, whereas previous pump designs necessarily employed annular grooves within the plunger bores to remove the leak-off fuel, fuel pumps in accordance with the present invention need only utilize an inexpensive leak-off bore extending through the pump body and into the plunger bore to provide an adequate leak-off fuel spill path.

Numerous other advantages and features of the present invention will become apparent to those of ordinary skill in the art from the following detailed description of the invention, from the claims and from the accompanying drawings.

DESCRIPTION OF THE DRAWINGS

The preferred embodiment of the present invention will be described below with reference to the accompanying drawings wherein like numerals represent like structures and wherein.

DESCRIPTION OF THE PREFERRED EMBODIMENTS

Figure 1:
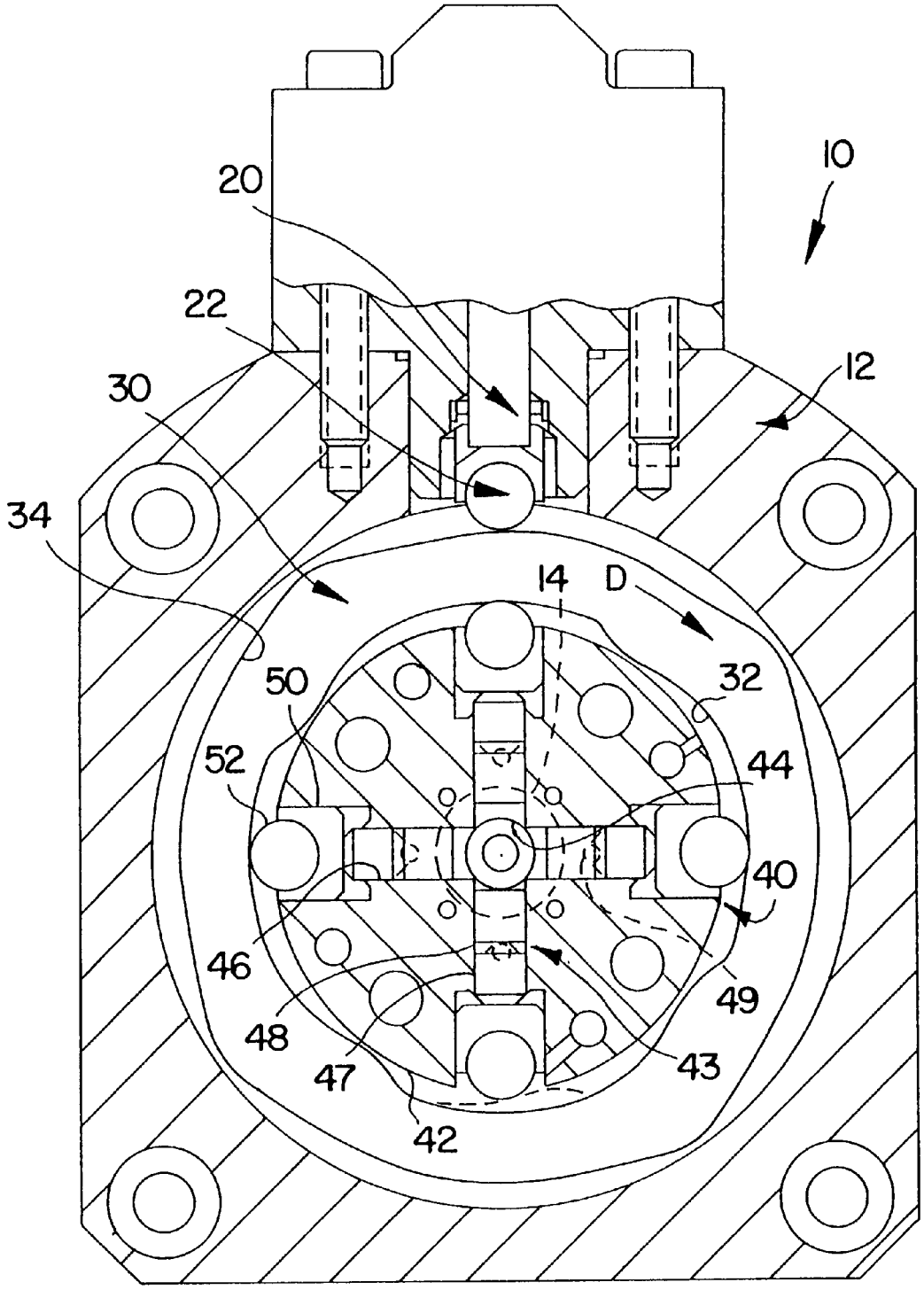
FIG. 1 is a cross sectional elevation view of a fuel pump in accordance with one embodiment of the present invention.

A first preferred embodiment of a fuel pump according to the invention will be described with primary reference to FIGS. 1 and 2*b*. Those of ordinary skill will recognize the pump 10 shown therein as being a high-pressure fuel pump for use with a diesel engine. As shown in FIG. 1, fuel pump 10 comprises a fuel pump housing 12 within which is housed a transfer pump 20, a high pressure pump 40, an annular cam ring 30 and a rotary drive shaft 14 (shown in phantom) which urges annular cam ring 30 to rotate in the direction of arrow D during operation of pump 10. High pressure pump 40 includes a high pressure pump body 42 which defines a plurality of radially oriented plunger bores 46 and a plurality of leak-off bores 49. High-pressure pump 40 also includes a plurality of composite plungers 43 disposed within respective pumping plunger bores 46 for reciprocal movement therein. High-pressure pump 40 further comprises a plurality of intermediate members, including shoes 50 and rollers 52, which are also disposed within pump body 42 for reciprocation therein.

As shown in FIG. 1, rotation of annular cam ring 30 causes rollers 52 to ride along the first cam surface 32 which defines the inside of annular cam ring 30. This, in turn, imparts motion to shoes 50 and composite plungers 43 to provide alternating intake and pumping phases of operation of high-pressure pump 40. During the intake phase of operation, a charge of fuel is loaded into pumping chamber 44. During the pumping phase of operation, this charge of fuel is delivered from pumping chamber 44 at high-pressure to a fuel utilization device such as a common fuel supply rail to which one or more fuel injectors are connected. The reciprocal motion of composite plungers 43 within bores 46 is derived from the rotational motion of cam ring 30. Naturally, this means that force components which are both tangential and radial relative to the axis of cam ring 30 are cyclically transmitted to plungers 43 via the intermediate members. As noted below, the tangential force components are undesirable and are eliminated by the construction of the present invention.

Fuel pump 10 also includes transfer pump 20 with a reciprocating transfer plunger assembly 22 for providing alternating intake and transfer phases of operation of the transfer pump due to the cooperation of transfer plunger 22 and a second cam surface 34, which defines the outside of annular cam ring 30, during rotation thereof. The operation of transfer pump 20 results in the delivery of fuel to the intake of high pressure pump 40 for pressurization and delivery to a fuel utilization device as described above.

Figure 2A:
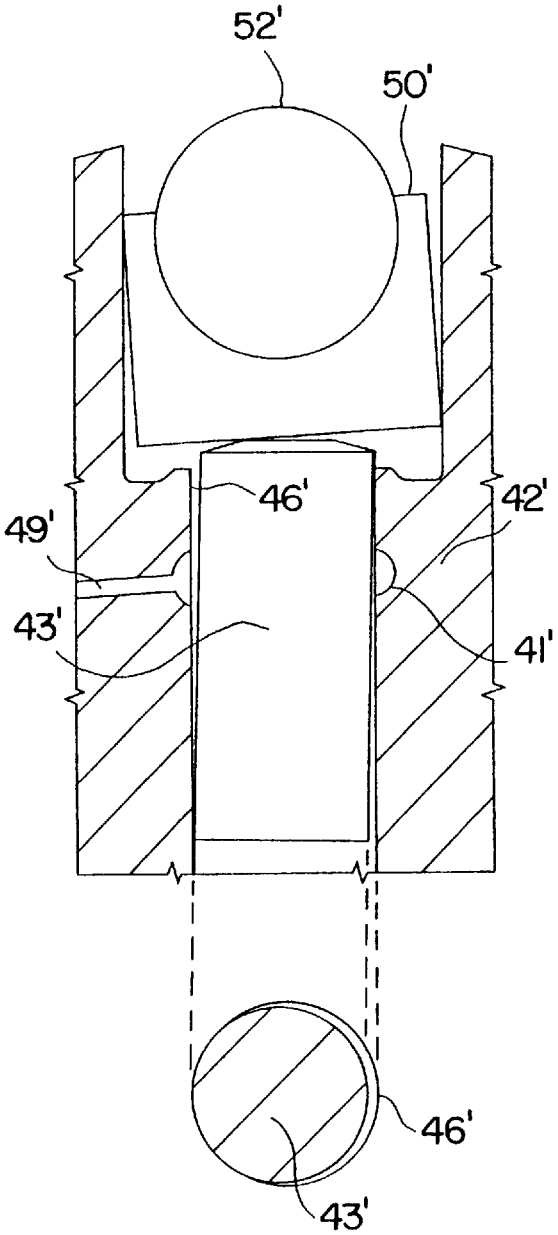
FIG. 2A PRIOR ART
FIG. 2*a* is a schematic representation of the operation of a conventional plunger within a conventional fuel pump.
Figure 2B:
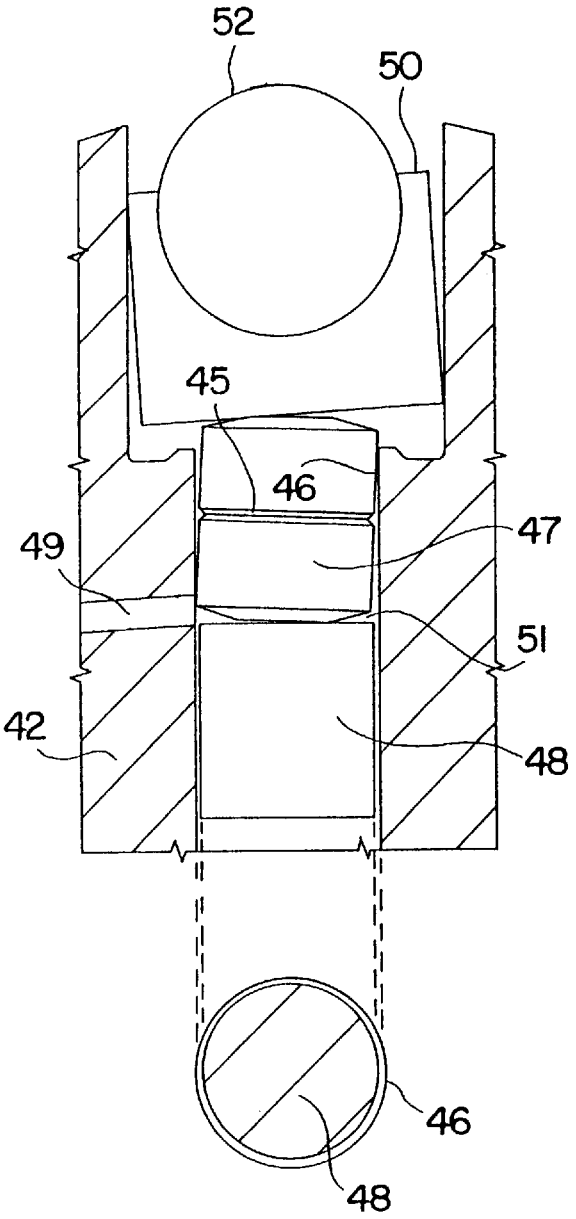
FIG. 2*b* is a schematic representation of the operation of a composite plunger within a fuel pump in accordance with the present invention.

As can be seen in FIG. 1, and with greater clarity in FIG. 2*b,* each composite plunger 43 is preferably comprised of a high-pressure plunger element 48 and a leak-off plunger element 47. High-pressure plunger element 48 is preferably substantially cylindrical in shape and may have slightly rounded or bevelled edges on each end thereof. By contrast, leak-off plunger element 47 is generally cylindrically shaped but preferably is convexly contoured at both ends thereof. These contours can include the surface of a hemisphere, a paraboloid of revolution, an ellipsoid, a cone or other non-planar volume. Such contouring ensures elimination of any tangential force component transferred to element 48 by roller 52 and shoe 50. Thus, only radial force components act on element 48.

Contouring the ends of element 47 achieves the force transfer described above by ensuring that, regardless of the position or orientation of element 47, elements 47 and 48 only contact one another in a central region of their respective confronting end faces and, preferably, at one point. While the ends of element 47 are preferably spherical in shape and the ends of element 48 are preferably planar, any combination of shapes which allows the force transfer as described above can also be utilized. Naturally, the end face of element 48 which confronts element 47 should be non-complementary vis-a-vis the confronting end face of element 47 to ensure force transfer at the center of element 48.

The composite plungers 43 of the present invention enable plunger elements 48 to freely reciprocate within plunger bores 46 in a near-ideal and self-centering manner. As shown in the lower half of FIG. 2*b,* element 48 remains equidistant from the walls defining plunger bore 46 during reciprocal movement therein. Thus, while element 47 may experience some degree of canting during reciprocation, this does not degrade the movement of element 48. Since the movement of element 48 approximates ideal movement much more closely than in the related art, element 48 may have a larger diameter than element 47 to create a tight seal between element 48 and bore 46. For example, while the nominal (i.e. unloaded) clearance between element 48 and bore wall 46 is preferably only about 0.100 and 0.125 mils (2.54 and 3.175 microns), the clearance between element 47 and bore wall 46 is preferably between 0.20 and 0.25 mils (5.08 and 6.35 microns). The resulting tighter seal minimizes the flow of leak-off fuel from pumping chamber 44 radially outwardly through the interface between element 48 and bore 46.

By contrast to the present invention, FIG. 2*a* illustrates the canted orientation of conventional plunger 43' during reciprocation within conventional plunger bore 46'. As shown in the lower portion of FIG. 2*a,* this results in an asymmetric interface between plunger 43' and the wall of bore 46'. In addition to causing unduly large frictional forces therebetween, the canting of plunger 43' creates a large interface passage for leak-off fuel to pass therethrough. Since the interface in the present invention is both uniform and small, the tendency for fuel to pass therethrough is greatly reduced. In order to remove any fuel and/or oil which may have seeped between plunger 43' and bore wall 46', a leak-off annulus 41' and a cooperating leak-off bore 49' are provided.

As best seen in FIG. 2*b,* the confronting faces of elements 47 and 48 according to the invention inherently create a gallery 51 in which any fuel which does leak past element 48 can collect. When gallery 51 becomes aligned with a simple leak-off bore 49 as in FIGS. 1 and 2*b,* the fuel collected in gallery 51 can pass to a low-pressure fuel return which is fluidly connected to leak-off bore 49. Thus, the invention does not need to utilize a leak off annulus as does the related art. This leak-off is desirable because the components which actuate the leak-off plunger 37, e.g., cam ring 30, roller 50 and shoe 52, are exposed to oil for lubrication during use. Allowing excess fuel to leak-off as described above prevents contamination of the oil and subsequent cam roller damage.

An annular groove 45 is preferably disposed on the surface of element 47 so that element 47 may be easily distinguished from element 48 during assembly of pump 10. Groove 45 is desirable because, in the practice of this invention, elements 47 and 48 have different shapes and dimensions, but are substantially similar in appearance to the human eye. Groove 45 ensures that elements 47 and 48 are inserted into bores 46 in the proper order and orientation during assembly of pump 10.

Figure 3:
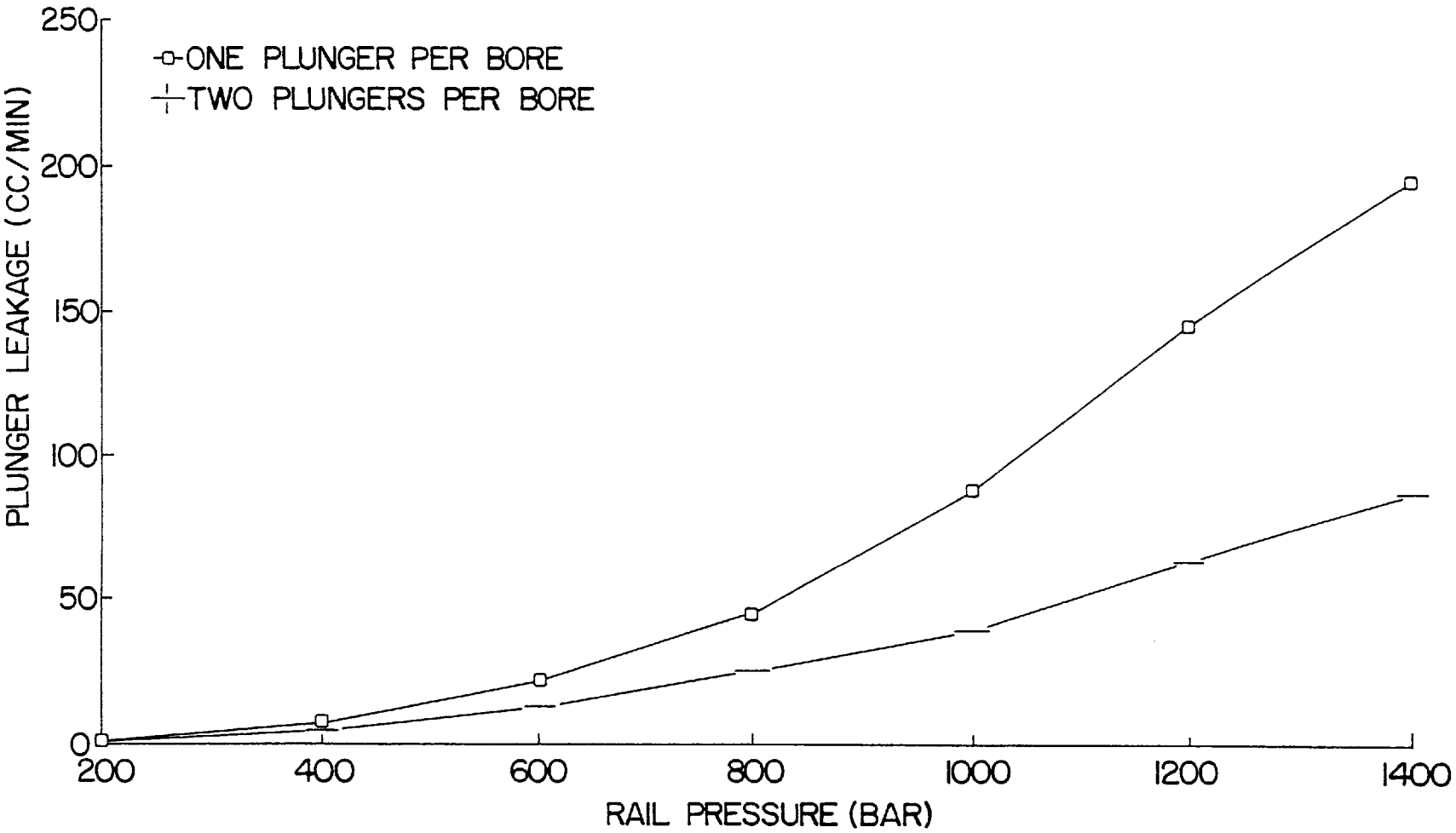
FIG. 3 is a chart comparing leak-off fuel rates of conventional fuel pumps versus fuel pumps in accordance with the present invention.

FIG. 3 illustrates the fuel leak-off rates for a typical pump utilizing conventional plungers in comparison with the fuel leak-off rates in a pump of the present invention. The data shown was taken while running a diesel engine at approximately 2,000 rpm and fuel leakage rates were measured for various fuel supply pressures from 200 Bar to 1400 Bar (2,900 psi to 20,300 psi). Those of ordinary skill will recognize that a pressure of 1,000 Bar (14,500 psi) is typical of common-rail fuel injection systems used with diesel engines. As illustrated in FIG. 3, the fuel leak-off rates measured in pumps of the present invention were approximately half of those measured in the conventional pumps. Therefore, the fuel leak-off rates of the present invention are markedly lower than those of conventional fuel pumps.

Figure 4B:
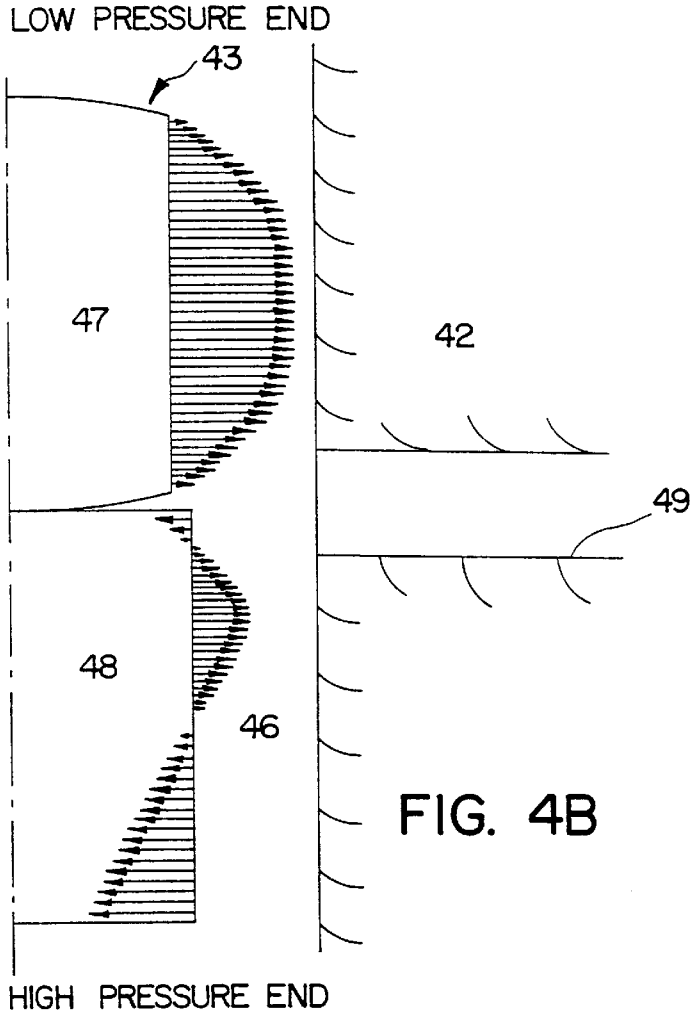
FIG. 4*b* is a diagram depicting the deformation in a composite plunger in accordance with the present invention.
Figure 4A:
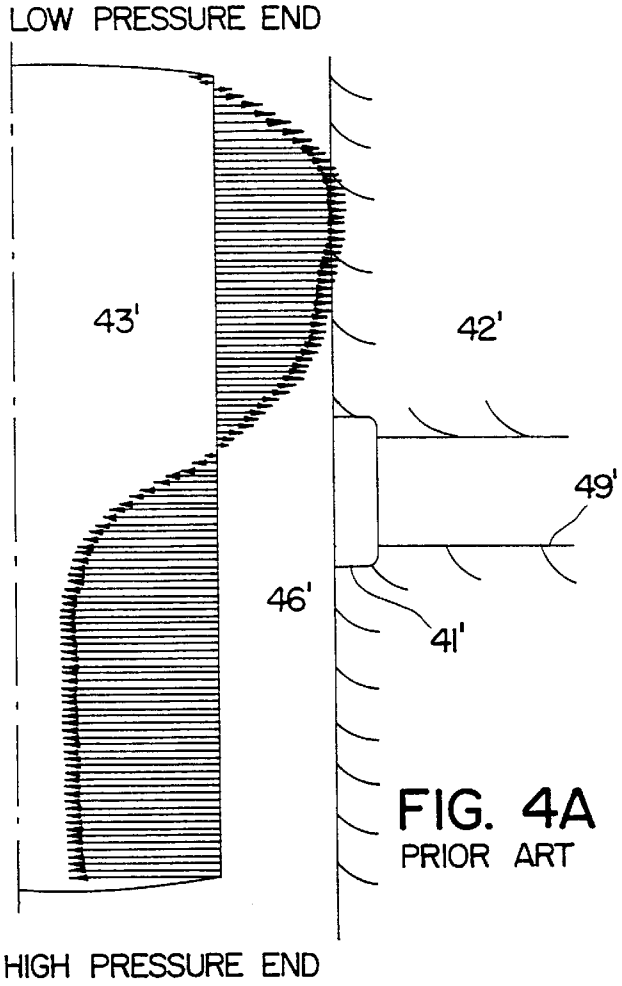
FIG. 4A PRIOR ART
FIG. 4*a* is a diagram depicting plunger deformation in a conventional plunger.

FIGS. 4*a* and 4*b* illustrate plunger deformations occurring in a conventional plunger 43' as well as a composite plunger 43. As shown in FIG. 4*a,* plunger 43' experiences compressive forces which cause significant radially expansion of the plunger near the end which contacts the shoe 50' (the upper half of FIG. 4*a*). This radial expansion is typically about 0.04 mils (1.016 microns) during normal operation of a diesel engine. Also, as shown in FIG. 4*a,* such radial expansion causes plunger 43' to temporarily seize against bore wall 46' due to contact with pressure pump body 42' at the upper half of plunger 43' (i.e., the shoe end of plunger 43'). This temporary seizure occurs even in the absence of plunger-canting during movement of 43'.

By contrast, FIG. 4*b* illustrates plunger deformation occurring in composite plunger 43 during normal operation thereof in a diesel engine. Significantly, most of the radial expansion occurring in plunger 43 occurs at element 47 (i.e., at the shoe end of composite plunger 43). Typical radial expansion of element 47 is approximately 0.04059 mils (1.031 microns) while that of element 48 is only about 0.00803 mils (0.204 microns). As shown in FIG. 4*b,* such radial expansion still provides for adequate clearance between composite plunger 43 and pump body 42. The larger diameter of plunger element 48, therefore, still maintains clearance from pump body 42. Thus, FIG. 4*b* illustrates that composite plunger 43 is capable of free travel within bore 46 despite the presence of some radial expansion thereof in normal usage.

Figure 5:
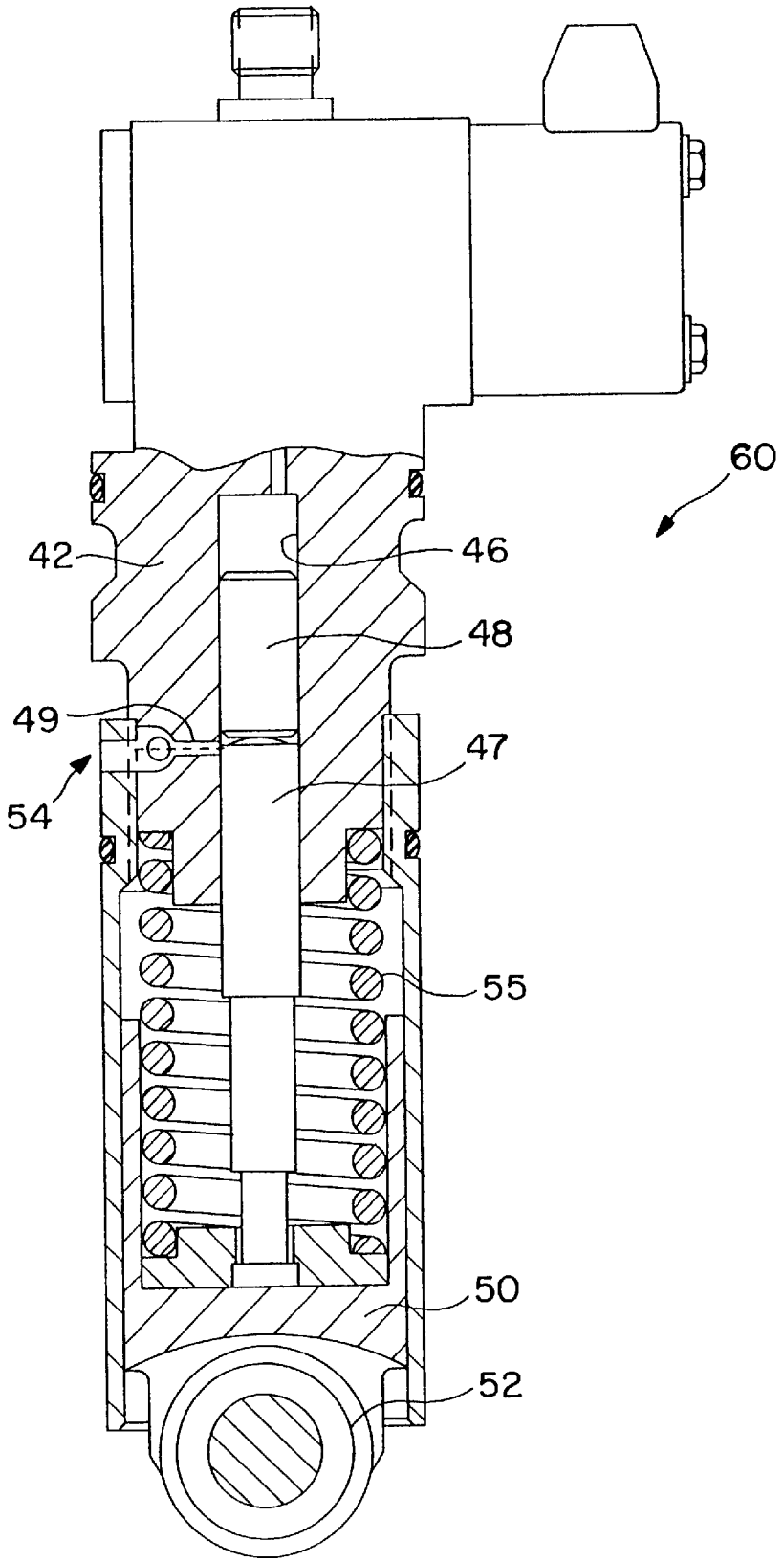
FIG. 5 is a cross-sectional elevation view of a fuel pump in accordance with another embodiment of the present invention.

A further preferred embodiment of the present invention is depicted in FIG. 5. Those of ordinary skill will readily appreciate that pump 60 of FIG. 5 is either unit pump or submerged pump style fuel pump for use with a diesel fuel injector. As shown therein, pump 60 includes pump body 42 which defines low-pressure fuel bore 49 and pump plunger bore 46. Disposed within pump body 42 are a high pressure plunger element 48 and leak-off plunger element 47. Pump 60 is also provided with an intermediate member including a shoe 50 and a roller 52 as shown. It will naturally be appreciated that the various components of fuel pump 60 operate in the same general manner as those of fuel pump 10. In particular, roller 52 drives shoe 50 and plunger elements 47 and 48 to selectively deliver a charge of fuel to a fuel utilization device in a desired cyclic fashion.

Pump 60 of FIG. 5 can also include a check valve such as ball check 54. In pump 60, ball check 54 serves to allow unrestricted disposal of fuel and/or oil leaking into gallery 51 during the pumping phase of operation of pump 60 while inhibiting the separation of plungers 47 and 48 after the pumping phase of operation ceases. This is achieved because of the vacuum created between plungers 47 and 48 when ball check 54 is closed and plunger 48 is driven downwardly under the influence of a spring 55.

It should be appreciated that many variations of the present invention are possible. For example, plunger elements 47 and 48 could be formed in a wide variety of cross sections. Other embodiments of the present invention contemplate composite plungers formed of more than two plunger elements and one or more of these may include one or more annular grooves along the length thereof to distinguish each plunger element from one another. Naturally, each of the plunger elements of the present invention could have contoured ends of one form or another. However, it is desirable that no two abutting end faces of plunger elements have complementary mating surfaces which would cause abutting elements to rigidly engage one another. Finally, and as noted above, the principles of the present invention discussed herein are readily adaptable to a wide variety of well-known and commonly used types of high-pressure fuel pumps.

While the present invention has been discussed in connection with what is presently considered to be the most practical and preferred embodiments, it is to be understood that the invention is not limited to the disclosed embodiments, but is intended to cover various modifications and equivalent arrangements included within the spirit and scope of the appended claims.

What is claimed is:

1. In a fuel pump of the type having a rotary drive shaft, a high pressure pump with at least one reciprocating pumping plunger each disposed with clearance within a substantially uniform surrounding wall defining a respective plunger bore, one end of each plunger cooperating with the respective plunger bore to define a high pressure pumping chamber, plunger actuating means driven by the drive shaft and acting on the other end of each plunger for converting rotary movement of the drive shaft into reciprocating movement of the pumping plungers to thereby provide alternating intake and pumping phases of plunger operation for respectively receiving an intake charge of fuel into the pumping chamber, pressurizing the fuel therein, and delivering fuel at high pressure to a fuel utilization device, and a fuel transfer pump for transferring fuel to the pumping chamber during the intake phase of operation of the high pressure pump, wherein the improvement comprises:

each of said pumping plungers is a composite pumping plunger having two discrete substantially cylindrical plunger elements stacked in the direction of reciprocation of said composite pumping plunger and having a cross section which is less than but substantially equal to the cross section of the plunger bore, one of said plunger elements defining said one end of the plunger cooperating with the plunger bore to define a pumping chamber, and the other of the plunger elements being in contact with the plunger actuation means, and the clearance between the other plunger element and said pumping plunger bore wall is about 0.1 mil greater than the clearance between the first plunger element and the pumping plunger bore wall.

2. The pump of claim 1, wherein at least one of said discrete plunger elements is contoured at at least one end thereof whereby an annular gallery is formed between the confronting faces of said plunger elements and the bore wall which surrounds said plunger elements.

3. The pump of claim 2, wherein said pump further comprises means defining a leak-off fuel return associated with each of the pumping plunger bores, the gallery formed between said plunger elements of each of said composite pumping plungers defines an annular fuel leak-off gallery, and said fuel leak-off galleries cooperate with said leak-off fuel returns to remove fuel which seeps into said fuel leak-off galleries.

4. The pump of claim 2, wherein the plunger actuating means comprises:

a rotatable annular member driven by the drive shaft, and a shoe-roller assembly situated between each of said composite plungers and said annular member, said annular member, said roller assemblies and said composite plungers cooperating with one another whereby rotation of the annular member imparts a linear actuating force through said roller assemblies to said composite plungers.

5. In a high-pressure fuel pump of the type having a pump body which defines at least one pumping plunger bore with an at least substantially constant cross-section, a pumping plunger movably disposed within each pumping plunger bore for reciprocation therein, and a pumping plunger actuator for reciprocating the pumping plungers to provide alternating intake and pumping phases of operation of the high-pressure pump, the pump receiving fuel during the intake phase of operation and delivering fuel at high-pressure to a fuel utilization device during the pumping phase of operation, wherein the improvement comprises:

each of said pumping plungers comprising a composite pumping plunger including at least two discrete plunger elements stacked in the direction of reciprocation of said composite pumping plunger and having a cross-section which is less than, but substantially equal to, the cross-section of the plunger bore.

6. The pump of claim 5, wherein said discrete plunger elements are generally cylindrically shaped and wherein at least one of said discrete plunger elements is convexly contoured at at least one end thereof.

7. The pump of claim 6, wherein each composite pumping plunger consists of two discrete plunger elements, one of said plunger elements being a leak-off plunger element which is in contact with the pumping plunger actuator, and said leak-off plunger element is contoured at both ends thereof.

8. The pump of claim 7, wherein all of said plunger elements of each of said composite plungers have substantially the same nominal diameter.

9. The pump of claim 7, wherein each of said composite pumping plungers comprises first and second plunger elements, said first plunger element has at least one contoured end and contacts the plunger actuator during operation of the pump, and the nominal diameter of said first plunger element is less than the nominal diameter of said second plunger element.

10. The pump of claim 7, wherein each of said composite pumping plungers comprises first and second plunger elements, said first plunger element has at least one convexly contoured end and contacts the plunger actuator during operation of the pump, and said first and second plunger elements have substantially equal lengths.

11. The pump of claim 7, wherein each of said composite pumping plungers consists of two plunger elements, both of said plunger elements are only contoured at one end thereof, and said contoured ends of both of said plunger elements face the plunger actuator.

12. The pump of claim 7, wherein said pump further comprises means defining a leak-off fuel return associated with each of the pumping plunger bores, the interface between said plunger elements of each of said composite pumping plungers defines an annular fuel leak-off gallery, and said fuel leak-off galleries cooperate with said leak-off fuel returns to remove fuel which seeps into said fuel leak-off galleries.

13. The pump of claim 7, wherein the plunger actuator comprises:

a rotatable annular member driven by the drive shaft, and a shoe-roller assembly situated between each of said composite plungers and said annular member, said annular member, said roller assemblies and said composite plungers cooperating with one another whereby rotation of said annular member only imparts radial actuating forces to said second plunger element.

14. The pump of claim 5, wherein each composite pumping plunger consists of two discrete plunger elements, each plunger element having a substantially cylindrical side surface, and one of said plunger elements includes a recess disposed about its cylindrical surface.

15. The pump of claim 5, wherein the plunger actuator comprises:

a rotatable annular member driven by the drive shaft, and a shoe-roller assembly situated between each of said composite plungers and said annular member, said annular member, said roller assemblies and said composite plungers cooperating with one another whereby rotation of the annular member imparts a radial actuating force through said roller assemblies to said composite plungers.

16. A plunger for use with a high-pressure fuel pump of the type having a pump body defining at least one cylindrical pumping plunger bore which is at least substantially constant in cross-section for receiving said plunger and which permits reciprocal movement of said plunger within the cylindrical bore, said plunger comprising:

a composite of two discrete, substantially cylindrical plunger elements arranged coaxially and having confronting end faces, wherein at least one of said confronting faces is convexly contoured and the other of said confronting faces is not complementary in shape, and wherein the nominal diameter of one plunger element is different from the nominal diameter of the other plunger element, by about 0.1 mil.

17. The plunger of claim 16, wherein each confronting face of said plunger elements has a central region, and said confronting faces are only capable of contacting one another in said central regions thereof.

* * * * *